US005337961A

United States Patent [19]

Brambani et al.

[11] Patent Number: 5,337,961

[45] Date of Patent: Aug. 16, 1994

[54] CERAMIC TIP AND COMPLIANT ATTACHMENT INTERFACE FOR A GAS TURBINE FUEL NOZZLE

[75] Inventors: Eric J. Brambani; Jonathan Munshi, both of Schenectady, N.Y.

[73] Assignee: General Electric Company, Schenectady, N.Y.

[21] Appl. No.: 986,602

[22] Filed: Dec. 7, 1992

[51] Int. Cl.[5] ..... B05B 7/06

[52] U.S. Cl. ..... 239/397.5; 239/419.3; 239/422; 239/424; 239/600; 239/DIG. 4; 239/DIG.19

[58] Field of Search ..... 239/DIG. 4, DIG. 19, 239/400, 405, 406, 419.3, 422, 423, 424, 600, 418, 397.5

[56] References Cited

U.S. PATENT DOCUMENTS

| | | | |
|---|---|---|---|
| 2,942,790 | 6/1960 | Starkey et al. | 239/423 X |
| 3,028,102 | 4/1962 | Davies et al. | 239/422 X |
| 3,684,186 | 8/1972 | Helmrich | 239/400 |
| 3,713,588 | 1/1973 | Sharpe | 239/400 |
| 4,863,105 | 9/1989 | Bennett | 239/600 X |
| 5,060,869 | 10/1991 | Bekius | 239/600 X |
| 5,067,657 | 11/1991 | Young et al. . | |
| 5,253,810 | 10/1993 | Maltby et al. | 239/397.5 |

FOREIGN PATENT DOCUMENTS

| | | | |
|---|---|---|---|
| 2900578 | 1/1980 | Fed. Rep. of Germany | 239/DIG. 19 |
| 153613 | 7/1987 | Japan | 239/DIG. 19 |

*Primary Examiner*—Andres Kashnikow
*Assistant Examiner*—William Grant
*Attorney, Agent, or Firm*—Nixon & Vanderhye

[57] ABSTRACT

A fuel nozzle tip construction for a dual fuel gas turbine includes a centrally arranged metal liquid fuel tip having a liquid fuel flow passage therein; a radially outer ceramic atomizing air tip surrounding the liquid fuel tip in radially spaced and substantially concentric relationship such that an atomizing air passage is formed therebetween; a radially outermost metal gas fuel tip surrounding the atomizing air tip in radially spaced and substantially concentric relationship such that a gas fuel passage is formed therebetween; a metal retaining cup radially between the atomizing air tip and the gas fuel tip; and a pair of compliant interface elements, one interposed between the gas tip and the atomizing air tip at a forward end of the atomizing air tip, and the other interposed between the retaining cup and the atomizing air tip at a rearward end of the atomizing air tip.

11 Claims, 1 Drawing Sheet

CERAMIC TIP AND COMPLIANT ATTACHMENT INTERFACE FOR A GAS TURBINE FUEL NOZZLE

TECHNICAL FIELD

This invention relates generally to gas turbine fuel nozzles and specifically, to the use of ceramic material for at least a part of a fuel nozzle tip construction in order to minimize erosion caused by particles ingested into the gas turbine.

BACKGROUND PRIOR ART

Industrial gas fuel turbines are located in a wide variety of environments. Some environmental effects can cause either the formation of rust on the interior passages of fuel nozzles of infrequently operated gas fuel turbines, or the ingestion of sand particles into internal passages of normally operated gas fuel turbines located in dusty areas. The entrainment of these particles into the fuel nozzle passages, specifically in the atomizing air passages, and when sufficiently accelerated and swirled, will impact the atomizing air injection tips of the nozzles at high speeds and thus cause erosion. The erosion rates of these air tips varies greatly with location, i.e., environment, with some nozzle tips lasting until the next scheduled inspection. In some cases, however, the erosion rate of the atomizing air tips is high enough to cause unscheduled shut-downs of operating turbines due to deterioration of fuel nozzle performance. As will be appreciated, unscheduled shut-downs are not only an inconvenience to the operator, but also cause lost revenue.

Ceramic materials are currently being used for high pressure particle nozzles for sandblast applications. There has also been some utilization of ceramic nozzles for diesel operations involving coal slurry fuels. To the best of applicant's knowledge, however, no one has previously attempted to utilize ceramic materials in fuel nozzles of gas turbine engines.

SUMMARY OF THE INVENTION

The present invention attempts to solve the problem of component erosion by employing a wear resistant ceramic material and, in the process, the invention also addresses the concerns of attaching a ceramic material to surrounding metallic substructures. In this particular application, a ceramic nozzle tip for atomizing air replaces the previously employed metal tip, thus addressing wear and erosion problems due to sand particle ingestion. The high hardness property of ceramics makes it a very good candidate for resisting erosive wear due to entrained particles in a flow path, such as the atomizing air flow path. The fuel nozzle components are exposed to relatively low temperatures during operation, so that in this application, the wear properties of ceramics are considered more significant than their known and otherwise desirable high temperature properties.

The most significant obstacle for the implementation of ceramic materials as a replacement for metals is how such materials are to be attached to surrounding or adjacent metal components. The reason for this concern is due to the fundamental differences between ceramic and metallic materials, some of which are set forth below:

| | Ceramics | Metals |
|---|---|---|
| Thermal Expansion | low | high |
| Hardness | high | low |
| Ductility | brittle | good |
| Young's Modulus | higher | high |

These four major differences will generally lead to failure of either the metallic or ceramic component when they are put into direct contact with each other in any assembly. In accordance with this invention, a compliant interface is provided between the ceramic atomizing air tip and adjacent metallic support hardware in order to minimize the adverse effects of the basic material differences listed above.

Thus, the principal object of this invention is to utilize a high hardness ceramic material in a gas turbine fuel nozzle to enable the fuel nozzle to withstand high erosive wear conditions, and at the same time provide a compliant interface between the brittle ceramic atomizing air tip and a surrounding metal retaining cup and gas fuel tip in order to minimize any stress concentrators therebetween.

In one exemplary embodiment of the invention, a gas turbine fuel nozzle is provided which includes, in a generally concentric arrangement, from radially outermost to radially innermost, the following components: a gas fuel tip, a retaining cup, a ceramic atomizing air tip, and a liquid fuel (oil) tip. In its assembled form, a first annular spring seal is located at the forward end of the ceramic air tip, radially between the ceramic air tip and the adjacent metal gas tip. At the same time, a second annular spring seal is provided at the interface between the rearward end of the ceramic air tip and a forward end of the metal retaining cup. These two spring seals effectively isolate the ceramic air tip from the adjacent metallic support components at both ends of the ceramic tip. The assembly is engineered to account for the thermal growths of all components to insure that sealing integrity is not compromised and that compliancy is effective over the whole temperature range of operation.

Thus, in its broadest aspect, the invention comprises a fuel injection nozzle for a gas turbine wherein a nozzle tip assembly including radially inner and outer components defining an atomizing air passage, the improvement wherein one of the radially inner and outer components is ceramic.

In another aspect, the invention comprises a nozzle tip construction comprising a fuel injection nozzle for a gas turbine engine, a nozzle tip construction comprising first, second and third substantially concentrically arranged components defining separate gas fuel, atomizing air, and liquid fuel passages terminating at respective gas, atomizing air and liquid fuel discharge orifices, wherein at least one of the first, second and third components defining at least in part the atomizing air passage is constructed of ceramic material.

In still another aspect, the invention provides a fuel nozzle tip construction for a dual fuel gas turbine comprising a centrally arranged metal liquid fuel tip having a liquid fuel flow passage therein; a radially outer ceramic atomizing air tip surrounding the liquid fuel tip in radially spaced and substantially concentric relationship such that an atomizing air passage is formed therebetween; a radially outermost metal gas fuel tip surrounding the atomizing air tip in radially spaced and substantially concentric relationship such that a gas fuel passage is formed therebetween; a metal retaining cup radially between the atomizing air tip and the gas fuel tip; wherein compliant interface elements are interposed between the gas tip and the atomizing air tip at a forward end of the atomizing air tip, and between the retaining cup and the atomizing air tip at a rearward end of the atomizing air tip.

Additional objects and advantages of the invention will become apparent from the detailed description which follows.

BRIEF DESCRIPTION OF THE DRAWINGS

The single FIGURE is a cross-section of the forward end or tip assembly of a gas turbine fuel nozzle in accordance with an exemplary embodiment of the invention.

BEST MODE FOR CARRYING OUT THE INVENTION

Figure 1:
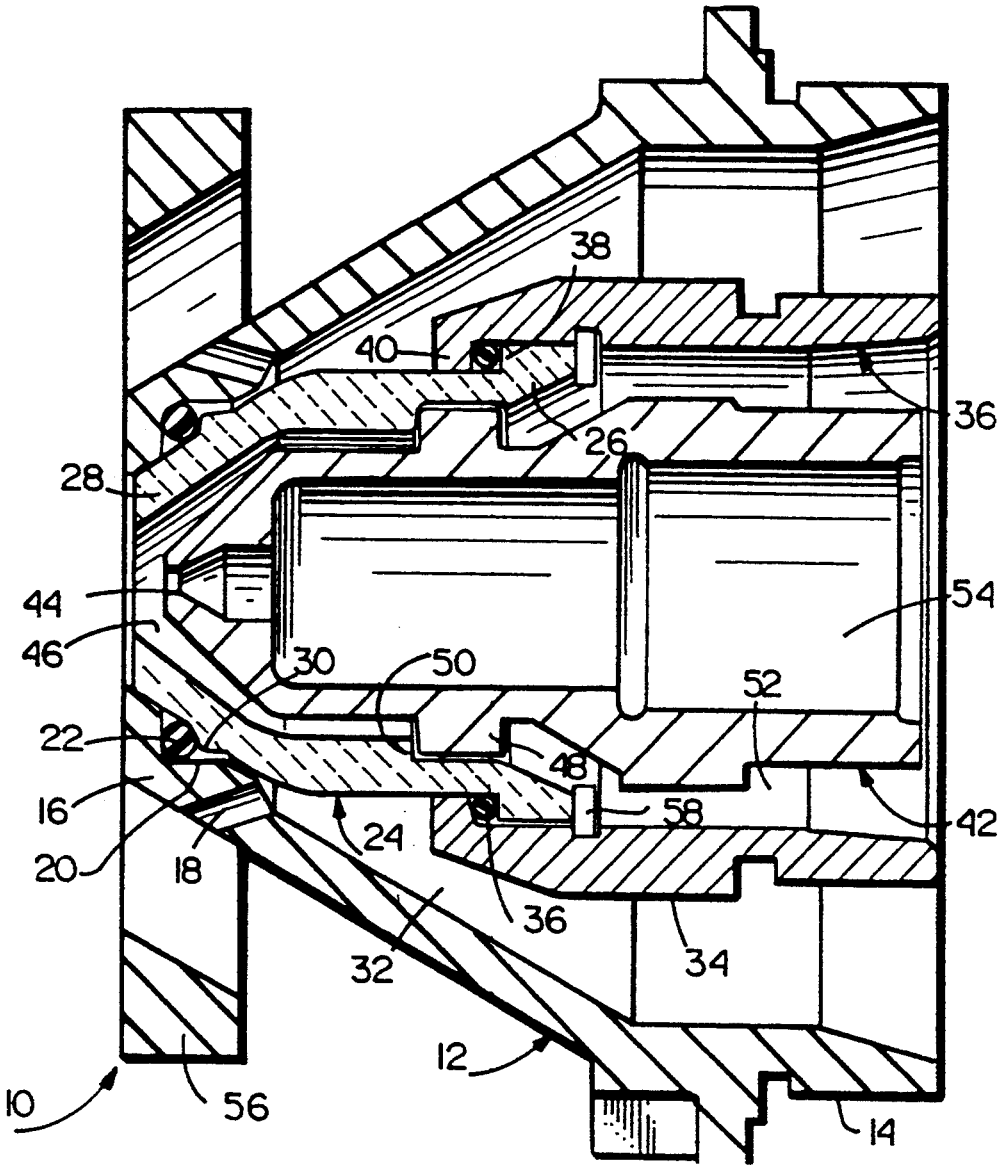

With reference now to the single drawing FIGURE, the forward tip portion 10 of a dual fuel nozzle for a gas turbine engine includes an outermost metal gas fuel tip 12 which tapers forwardly and inwardly from a first diameter and rearward connecting end 14 to a forward discharge end 16. The gas fuel tip 12 is provided with a plurality of gas fuel discharge orifices 18 located in a generally circular array about the forward end of the gas tip. The gas fuel tip 12 is also provided with an interior annular groove 20 adjacent the forward discharge end 16. The groove 20 is designed to receive a sealing spring 22 as will be described in further detail below.

A ceramic atomizing air tip 24 is arranged radially inwardly and concentrically with respect to the metal gas tip 12. The ceramic air tip 24 likewise comprises a rearward connecting end 26 and a forward, inwardly tapered discharge end 28. The inward taper of the discharge end 28 of the ceramic air tip generally corresponds to the inward taper of the forward end 16 of the outer gas tip 12 as best seen in the FIGURE. The forward discharge end 28 is provided with a radially outwardly extending abutment or shoulder 30 which cooperates with the groove 20 in the outer gas tip 12 to hold the annular spring seal 22 in place between the outer gas tip 12 and the inner ceramic air tip 24. The seal 22 at the same time closes off the annular gas passage 32 between the outer gas tip 12 and the ceramic air tip 24, thus forcing the gas fuel to exit orifices 18.

A metal retaining cup 34 surrounds the rearward connecting portion 26 of the ceramic air tip 24 and a second annular spring seal 36 is located between a radially outwardly extending flange 38 at the rear end of the ceramic air tip 24 and a radially inwardly directed flange 40 at the forward end of the retaining cup 34.

Radially inwardly of the ceramic air tip 24, there is located a metal liquid fuel (for example, oil) tip 42 which tapers to a forward discharge orifice 44 located just behind the orifice 46 of the ceramic air tip 24. An annular, radially outwardly directed and circumferentially discontinuous flange 48 forms an air swirler on the liquid fuel tip 42 which is designed to abut a shoulder 50 on the interior of the ceramic air tip 24.

The radial space between the radially outermost gas tip 12 and the ceramic air tip 24 (and metal retaining cup 34) establishes the gas fuel path 32 by which gas fuel is directed from the nozzle through the discharge orifices 18 into the combustion chamber. At the same time, the radial space between the ceramic air tip 24 (and metal retaining cup 34) and the radially innermost fuel tip 42 establishes atomizing air flow path 52 by which atomizing air is directed through the swirler 48 for discharge through the central orifice 46 in the ceramic air tip. Finally, liquid fuel (when used) is adapted to flow through the fuel path 54 defined by the interior of the centrally located liquid fuel tip 42. The liquid fuel is directed through the central, circular discharge orifice 44 where it mixes with atomizing air exiting the orifice 46.

An annular air swirler 56 is affixed to the external surface of the outer gas fuel tip 12 for swirling combustion air introduced into the combustion chamber externally of the nozzle per se. The combustion air is mixed with the fuel/air exiting the nozzle in a known manner.

In the assembly process for the above described fuel nozzle tip assembly, the liquid fuel tip 42 is screwed (or otherwise secured) onto a fuel insert manifold (not shown). Over the liquid tip 42, the atomizing air tip assembly is attached. The atomizing air tip assembly contains the ceramic atomizing air tip 24, the retaining cup 34, the spring seal 36 and a snap ring 58. This subassembly is placed together by sliding the spring seal 36 into the retaining cup, and then sliding the ceramic air tip 24 into the retaining cup 34. The snap ring 58 is then put into place to hold the subassembly together and to allow for easy installation. The atomizing air tip assembly is then screwed onto the fuel insert manifold over, and concentric with, the liquid fuel tip 42. The atomizing air tip assembly is tightened to the point where the shoulder 50 in the ceramic air tip 24 engages the atomizing air swirler 48. This engagement will cause the spring seal to deform slightly, acting as a seal as well as a compliant interface between the metal swirler and the ceramic air tip. The outer gas fuel tip 12 is then placed over the atomizing air tip assembly, but not before another spring seal 22 is placed between the ceramic tip 24 and the outer gas fuel tip 12, sandwiched in groove 20 by the shoulder 30. The two spring seals effectively isolate the inner ceramic air tip 24 from the metallic support components around it, i.e., the retaining cup 34 and the outer gas tip 12. At the same time, the seals 22 and 36 effectively prevent leakage of gas fuel and atomizing air from their respective flow passages.

The operation of the fuel nozzle is as follows. The atomizing air flow (displayed in FIG. 1) is always on whether there is gas fuel or liquid fuel operation. When operating on gas fuel the flow of air through passage 52 will prevent gas fuel build-up. Operating this fuel nozzle assembly 10 on liquid fuel, the air will assist in atomizing the liquid fuel spray to facilitate proper combustion of the fuel. The flow of air through the atomizing air passage 52 will vary proportionally with the increased flow in fuels. As the atomizing air flows down the passage 52, its velocity will increase due to the narrowing of the passage. The air will pass through the swirler 48, and be accelerated even more before being redirected by the tapered end of the tip 24. When the atomizing air has entrained solid particles, the redirection of the flow will result in these particles impacting the air tip 24, hence causing the basic wear problem. This problem is effectively addressed by the use of ceramic material for the atomizing air tip 24. At the same time, the successful utilization of the ceramic material in the otherwise metal nozzle construction is facilitated by the use of thin metallic, compliant seals 22 and 36 which may be of any suitable temperature resistant alloy such as In-718.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. In a fuel injection nozzle for a gas turbine wherein a nozzle tip assembly includes radially inner and outer components defining an atomizing air passage, the improvement comprising constructing said radially outer component of ceramic material, and wherein said nozzle tip assembly includes a metallic radially outermost component which in cooperation with said radially outer ceramic component defines a gas fuel passage, and further wherein said radially outer ceramic component is isolated from said metallic radially outermost component by at least one compliant metallic spring seal.

2. The fuel injection nozzle of claim 1 wherein said radially inner component comprises a hollow tubular member defining a liquid fuel passage.

3. The fuel injection nozzle of claim 2 wherein an annular retaining cup secures said radially outer ceramic member to said radially inner member.

4. The fuel injection nozzle of claim 3 wherein a compliant metallic spring seal is interposed between said retaining cup and said radially outer ceramic component.

5. The fuel injection nozzle of claim 1 wherein said radially outermost component is provided with a plurality of discharge orifices upstream of said metallic spring seal.

6. In a fuel injection nozzle for a gas turbine engine, a nozzle tip construction comprising first, second and third substantially concentrically arranged components defining separate gas fuel, atomizing air, and liquid fuel passages terminating at respective gas, atomizing air and liquid fuel discharge orifices, wherein said first component comprises a non-ceramic tubular member having a first inwardly tapered discharge portion and is adapted to introduce gas fuel into a combustion chamber of the gas turbine; and wherein said second component is constructed of ceramic material and lies radially inwardly of said first component and includes a second tapered discharge portion surrounded by said first inwardly tapered discharge portion of said first component, and wherein said third component is constructed of non-ceramic material, said air atomizing passage being defined between said second and third components.

7. The fuel injection nozzle of claim 6 wherein said third component lies radially inwardly of said second component and includes a third tapered discharge portion surrounded by said second tapered discharge portion, and wherein a liquid fuel passage is established in said third component.

8. The fuel injection nozzle of claim 6 wherein a first thin metallic compliant seal ring is interposed between said first and second components at said first and second tapered discharge portions.

9. The fuel injection nozzle of claim 8 wherein a metal retaining cup is located radially between said first and second components, and further wherein a second thin metallic compliant seal ring is interposed between said retaining cup and said second component.

10. A fuel nozzle tip construction for a dual fuel gas turbine comprising:

a centrally arranged metal liquid fuel tip having a liquid fuel flow passage therein;

a radially outer ceramic atomizing air tip surrounding said liquid fuel tip in radially spaced and substantially concentric relationship such that an atomizing air passage is formed therebetween;

a radially outermost metal gas fuel tip surrounding said atomizing air tip in radially spaced and substantially concentric relationship such that a gas fuel passage is formed therebetween;

a metal retaining cup radially between said atomizing air tip and said gas fuel tip; wherein compliant interface elements are interposed between said gas tip and said atomizing air tip at a forward end of said atomizing air tip, and between said retaining cup and said atomizing air tip at a rearward end of said atomizing air tip.

11. The fuel nozzle tip of claim 10 wherein said compliant interface elements are constructed of Inconel 718.

* * * * *